US008225442B2

(12) United States Patent
Davis

(10) Patent No.: US 8,225,442 B2
(45) Date of Patent: Jul. 24, 2012

(54) PRIVACY BLANKET

(76) Inventor: Valerie L. Davis, Pittsburgh, PA (US)

( * ) Notice: Subject to any disclaimer, the term of this patent is extended or adjusted under 35 U.S.C. 154(b) by 348 days.

(21) Appl. No.: 12/331,972

(22) Filed: Dec. 10, 2008

(65) Prior Publication Data

US 2010/0138996 A1 Jun. 10, 2010

(51) Int. Cl.
*A47C 16/00* (2006.01)

(52) U.S. Cl. ..... 5/655; 5/485; 5/494

(58) Field of Classification Search ..... 5/482, 485, 5/494, 502, 655; 2/48, 49.1, 49.2, 49.4, 69.5; D2/860, 861, 864; D6/603
See application file for complete search history.

(56) References Cited

U.S. PATENT DOCUMENTS 2,130,771 A * 9/1938 Mann ..... 2/69.5
3,789,546 A * 2/1974 Morrison ..... 446/327
4,637,075 A * 1/1987 Ingrisano et al. ..... 2/94
5,042,091 A * 8/1991 Tonkens ..... 2/94
5,245,717 A * 9/1993 Rudy ..... 5/507.1
6,105,170 A * 8/2000 Lisciandro et al. ..... 2/102
6,397,392 B1 * 6/2002 Wooley et al. ..... 2/102
6,643,870 B2 * 11/2003 Bertrand ..... 5/482
6,851,127 B1 * 2/2005 Khan ..... 2/89
2002/0088830 A1 * 7/2002 Rose ..... 224/153

OTHER PUBLICATIONS

"My Nuda", flyer, Valerie L. Davis, 1999.
"My Nuda", flyer, Valerie L. Davis, 2004 (showing three figures).
"My Nuda: Privacy & Security for the Breast-Feeding Mother & Infant"; brochure, Valerie L. Davis, 2007.

* cited by examiner

*Primary Examiner* — Robert G Santos
*Assistant Examiner* — Nicholas Polito
(74) *Attorney, Agent, or Firm* — The Webb Law Firm

(57) ABSTRACT

A privacy blanket, including a blanket body having a first side surface and a second side surface. At least one engagement portion is provided to removably engage the privacy blanket with a user. The privacy blanket further includes at least one functional portion for providing a containment area, a storage arrangement, and/or a working area.

16 Claims, 3 Drawing Sheets

PRIVACY BLANKET

BACKGROUND OF THE INVENTION

1. Field of the Invention

The present invention relates generally to blankets, cloaks, covers, shawls and the like, and in particular to a privacy blanket for use in connection with a variety of activities that, when conducted in a public place, may require some level of privacy, e.g., nursing, etc.

2. Description of the Related Art

People must often engage in activities in a public or semi-public place, even though such activities are preferably performed in private. Therefore, in order to maintain their privacy in such locations, some article or "shield" may be used to prevent passersby from viewing the person engaged in such activities. For example, many mothers nurse their children, and oftentimes, this nursing must occur at specified and/or inopportune times, e.g., while the mother and child is in a public or semi-public place. Also, the mother may need to express milk in order to "make" a bottle while she is situated in a public place. Similarly, even if providing the child milk from a bottle by the father, mother, relative, etc., many people prefer that the nursing (or feeding) process be a private affair. This also may be a preferably state for the feeding child, i.e., to be kept separate from the sounds, sights and smells of a public place, thereby reducing distractions during the feeding process.

According to the prior art, covers, shawls, capes, etc. have been provided for assisting in maintaining privacy in a public forum. However, many of these known arrangements include only a neck hole that must be appropriately positioned and is often uncomfortable to the user. Further, many of these known arrangements must be "thrown" over the shoulder, and often slip or fall due to the mother's or child's movement, thereby defeating the purpose of such privacy covers. In addition, these prior art arrangements make it difficult to rearrange the feeding child, e.g., switching sides, while still maintaining the private nature of the nursing or feeding process. Still further, these known arrangements are devoid of additional, functional features, and need to be carried around in a baby bag (or worn as a jacket). Therefore, there are considerable deficiencies with these prior art privacy covers, shawls, capes, etc., and there remains a need in the art for improved privacy blankets that include additional and beneficial functions.

SUMMARY OF THE INVENTION

It is, therefore, an object of the present invention to provide a privacy blanket that overcomes at least some of the above-mentioned drawbacks and deficiencies evident in the prior art arrangements. It is another object of the present invention to provide a privacy blanket that is easy to attach or otherwise associate with the user. It is a further object of the present invention to provide a privacy blanket that permits the user to rearrange the child (or otherwise shift positions and move around) while still maintaining the desired privacy. It is a still further object of the present invention to provide a privacy blanket that provides additional and beneficial features and components, leading to a multi-functional privacy blanket. It is another object of the present invention to provide a privacy blanket that is collapsible and easily transportable.

In order to address some or all of these objects, in one preferred and non-limiting embodiment, the present invention is directed to a privacy blanket, which includes a blanket body having a first side surface and a second side surface. At least one engagement portion is provided to removably engage the privacy blanket with a user. Further, the privacy blanket includes at least one functional portion for providing: a containment area, a storage arrangement, and/or a working area.

In another preferred and non-limiting embodiment, the present invention is directed to a privacy blanket, which includes a blanket body having a first side surface and a second side surface, and at least one engagement portion for removably engaging the privacy blanket with a user. In this embodiment, the blanket includes at least one functional portion for providing a containment area, a storage arrangement, and/or a working area, and the at least one functional portion is positioned on the first side surface of the blanket body. The second side surface of the blanket body is manufactured at least partially from a specified material, which is an absorbent material, a liquid-proof material, a liquid-resistant material, an insulator material, a padded material, a soft material, a fabric material, a quilted material, a non-abrasive material and/or a non-allergenic material.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 1(*b*) is a plan view of a second side of the privacy blanket of FIG. 1(*a*);

DETAILED DESCRIPTION OF THE PREFERRED EMBODIMENT(S)

Figure 1:
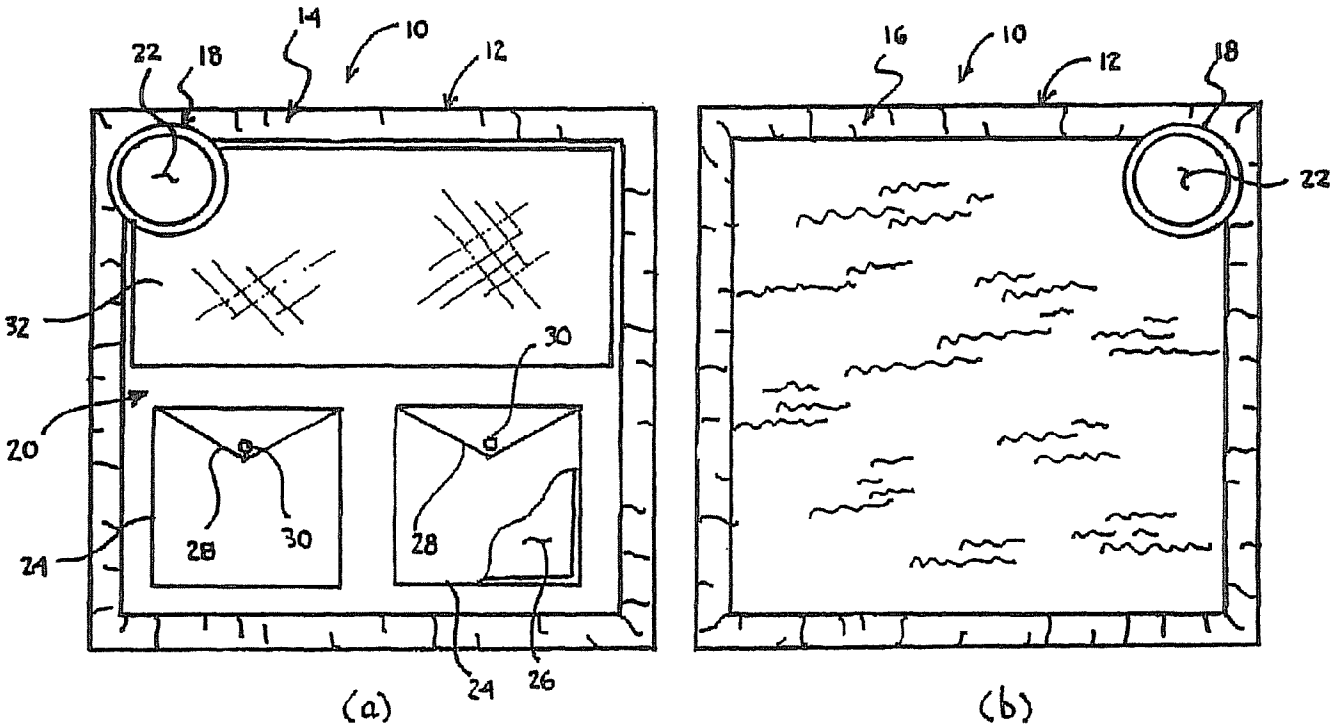
FIG. 1(*a*) is a plan view of a first side of one embodiment of a privacy blanket according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a privacy blanket 10, as illustrated in several preferred and non-limiting embodiments in FIGS. 1-8. While referred to as a "blanket," this term should also be construed to include covers, shawls, capes, cloaks, covers, cover-ups, etc. In addition, while discussed in connection with maintaining privacy during the nursing or feeding process between the user and a child, the privacy blanket 10 of the present invention can be used in any situation where the user would like to maintain some level of privacy in a public or semi-public area or forum.

The privacy blanket 10 includes a blanket body 12. The blanket body 12 has a first side surface 14 and a second side surface 16. Further, the privacy blanket 10 includes one or more engagement portions 18 that permit a user to removably engage the privacy blanket 10 with a part of their body. In addition, the privacy blanket has one or more functional portions 20 attached to or integral with the blanket body 12. For example, the functional portion 20 may be in the form of a containment or storage area or arrangement, a working area, etc.

As illustrated in the preferred and non-limiting embodiment of FIG. 1, the engagement portion 18 is in the form of an orifice 22 extending through the blanket body 12. In particular, this orifice 22 allows for the insertion of a body part of the user at least partially therethrough. For example, and as seen in the embodiment of FIG. 1, the user inserts their arm through the orifice 22 until the blanket body 12 is comfortably attached near the user's shoulder area. The privacy blanket 10 is shown in use in FIGS. 7 and 8, where the user has positioned their arm through the orifice 22. Further, it is envisioned that the area immediately surrounding the orifice 22 is formed from a specified material, such as a padded material, an elastic material, etc. In this manner, the privacy blanket 10, when engaged with the user, would be held comfortably in place around the user's shoulder, but would not overly constrict or rub against the user's body. Of course, any manner of comfortably connecting the blanket body 12 to the user in a removable manner is envisioned. For example, while the embodiment of FIG. 1 illustrates the specific positioning of the orifice 22 in one corner of the blanket body 12, the orifice 22 may also be positioned in the other corner, or as discussed hereinafter, in multiple areas on the blanket body 12.

As discussed above, the privacy blanket 10 of the present invention includes one or more functional portions 20 that provide additional and beneficial features to the privacy blanket 10. For example, in the embodiment of FIG. 1, the functional portions 20 include multiple containment areas in the form of a pocket 24 having an inner area 26, which is illustrated in FIG. 1 as a cut-away area on one of the pockets 24. Accordingly, the user may position items, objects, containers, or other things in the inner area 26 of the pockets 24 to appropriately contain and store them therein. To ensure that the items or objects are not lost or accidentally removed from the inner area 26 of the pocket 24, a closure portion 28 is movable between an open position to provide access to the inner area 26 of the pocket 24, and a closed position to prevent access to the inner area 26 of the pocket 24.

An attachment arrangement 30 may be used in connection with the closure portion 28 and/or pocket 24 in order to provide additional security for ensuring that the closure portion 28 is not inadvertently opened. It is envisioned that the attachment arrangement 30 may take a variety of forms, such as a clasp, a button, a zipper, a hook-and-loop arrangement, an adhesive arrangement, a tie arrangement, a string, a ribbon, an elongate structure, etc. Further, the attachment arrangement 30 may even be in the form of some locking structure or arrangement that allows for only authorized entry to the inner area 26 of the pocket 24.

As illustrated in FIG. 1(*a*), the functional portion 20 may also be in the form of a working area 32, which may be formed from a specified material that is attached to or integral with the first side surface 14 and/or the second side surface 16 of the blanket body 12. For example, the specified material may be an absorbent material, a liquid-proof material, a liquid-resistant material, an insulator material, a padded material, a soft material, a fabric material, a quilted material, a non-abrasive material, a non-allergenic material, etc. If the work area 32 is intended for use in changing a child's diaper or clothes, the specified material may be some absorbent, liquid-proof, liquid-resistant, or other similar material that would prevent any unwanted liquids or similar materials from affecting other parts of the privacy blanket 10. In addition, the specified material may be padded, soft, a fabric, a quilted material, a non-abrasive material, etc., such that the child is not uncomfortable when place thereon and manipulated during the changing process. In addition, the specified material may be non-allergenic in order to ensure that the child does not have an adverse reaction when his or her skin directly contacts the blanket body 12 and/or the working area 32.

As illustrated in FIG. 1(*b*), in another preferred and non-limiting embodiment, the second side surface 16 is also manufactured or formed from a specified material. As above, this material may be absorbent, liquid-proof, liquid-resistant, insulated, padded, soft, fabric, quilted, non-abrasive, non-allergenic, etc. However, in operation, and in this preferred embodiment, the second side surface 16 is the portion of the blanket body 12 that contacts the child during the nursing or feeding process. Accordingly, therefore, it is preferable that the specified material be insulated, padded, soft, fabric, quilted, non-abrasive, non-allergenic, etc. in order to ensure maximum comfort for both the user and the child in use.

Figure 2:
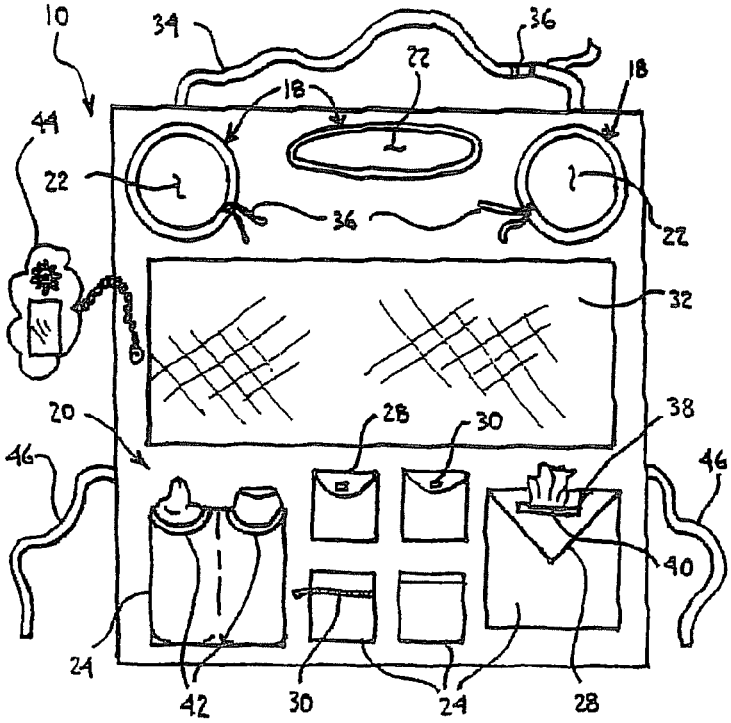
FIG. 2 is a plan view of a first side of another embodiment of a privacy blanket according to the principles of the present invention.

Another preferred and non-limiting embodiment of the present invention is illustrated in FIG. 2. As with the embodiment of FIG. 1, this embodiment also includes multiple functional portions 20 in the form of multiple pockets 24 and a working area 32. Further, in this embodiment, multiple orifices 22 are provided and extending through the blanket body 12 in order to provide the user with various possible configurations for removable attachment of the blanket body 12 to the user's body. In this embodiment, the user could insert their arms through any of the orifices 22 positioned on the blanket body 12, or their neck through the centrally-located orifice 22 on the blanket body 12. Also, this embodiment provides an additional engagement portion 18 in the form of an elongate structure 34, which is attached to or integral with the blanket body 12. As with the orifices 22 discussed above, this elongate structure 34 permits for the insertion of a body part of a user at least partially therethrough, e.g., the user's neck, arms, waist, etc. It is further envisioned that these orifices 22 and/or the elongate structure 34 are adjustable to fit users of different sizes using an adjustment arrangement 36. For example, this adjustment arrangement 36 may be in the form of a well-known strap/clip structure, a pull-tie structure, etc.

As seen in the embodiment of FIG. 2, the pockets 24 may have different closure portions 28 and/or attachment arrangements 30 in order to allow the addition and removal of items and objects from the pockets 24. For example, the closure portion 28 of one of the pockets 24 in the embodiment of FIG. 2 is in the form of an access slot 38. This access slot provides access to the inner area 26 of the pocket 24, and includes a slit 40 that is specifically designed to allow for the successive removal of a tissue, a wipe, a cloth material, a paper material, etc. from the inner area 26 of the pocket 24. For example, this access slot 38 and slit 40 may be in the form of the known structures provided on containers and/or bags of wipes, tissues and other similar products. In use, the bag of wipes or tissues (not shown) may be placed in the inner area 26 of this pocket 24 and successively removed through the access slot 38, i.e., through the slit 40. Alternatively, the wipes, tissues, etc. may be removed from their original packaging and placed directly in the inner area 26 of the pocket 24. Accordingly, the inner area 26 may be lined with a specified material that allows for the appropriate protection, resistance or other characteristics, dependent upon the items placed therein. For example, when used in connection with wipes or other wet or damp materials, the specified material may be a liquid-proof or liquid-resistant material, and may provide an effective seal such that these wipes do not dry out.

As illustrated in other pockets 24 in this embodiment, the pocket 24 may be specifically shaped or designed to receive other objects that are typically associated with a privacy blanket 10 according to the present invention. For example, as illustrated in FIG. 2, the pockets 24 on one portion of the blanket body 12 are specifically designed to accept bottles. Accordingly, the inner areas 26 of these pockets 24 may also be lined with a liquid-proof and/or liquid-resistant material, or even an insulated material to allow the bottles (and the liquid therein) to stay cooler (or warmer) for a longer period of time. Further, in order to ensure that the bottles do not accidentally fall out of the pockets 24, one or more elastic portions 42 can be provided and capable of tightening around at least a portion of the bottles that are placed within the inner area 26 of the pocket 24. Of course, other such specifically-designed functional portions 20 may be included. For example, the functional portion may be in the form of a toy 44 that can be permanently or removably attached to the blanket body 12 in a position that it is useful in entertaining the child. For example, a variety of removable and different toys 44 can be provided to entertain children of different ages. As also illustrated in FIG. 2, the engagement portions 18 (or, in this embodiment, elongate structures 34) may be in the form of ties 46. These ties 46 extend from opposing edges of the blanket body 12 and can be used to removably secure the blanket body 12 around a user, e.g., the user's waist.

While the embodiments of FIGS. 1 and 2 illustrate the privacy blanket 10 with a square-shaped blanket body 12, a variety of different shapes can be utilized. For example, FIG. 3(*a*) shows a circular shape, FIG. 3(*b*) shows a rectangular shape, and FIG. 3(*c*) shows a modified square shape (with a contoured portion to allow for easier positioning around the user's neck). However, any such shapes can be used without departing from the spirit or scope of the present invention.

Figure 4:
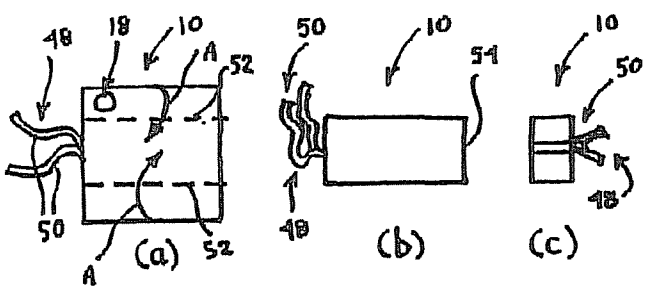
FIGS. 4(*a*)-(*c*) are plan views of another embodiment of a privacy blanket according to the principles of the present invention during a preferred collapsing process.
Figure 3:
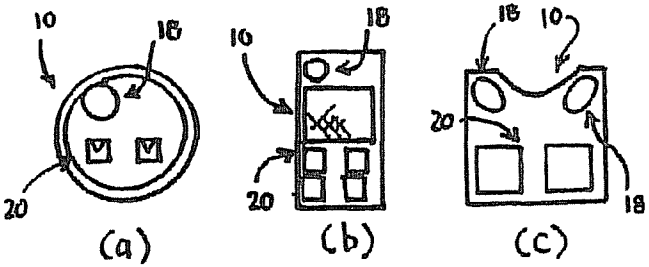
FIGS. 3(*a*)-(*c*) are plan views of a first side of additional embodiments of a privacy blanket according to the principles of the present invention.

Another feature of the presently-invented privacy blanket 10 is that it can be rolled or folded into a smaller and more portable arrangement. In order to keep the privacy blanket 10 in this rolled or folded position, one or more attachment arrangements 48 can be used. As seen in FIGS. 4(*a*)-(*c*), the attachment arrangement 48 may be in the form of two ties 50 extending from an edge of the blanket body 12. In order to collapse the blanket body 12 in this preferred and non-limiting embodiment, the blanket body 12 is folded in the direction of arrows A along fold lines 52. Once folded, the privacy blanket 10 is in the form illustrated in FIG. 4(*b*). Next, the user rolls the folded blanket body 12 starting at edge 54 and rolling towards the ties 50. Once rolled, the user then uses the ties 50 to wrap around the folded/rolled blanket body 12, thereby securing the blanket body 12 in this form by tying these ties 50 together. This collapsing process and arrangement results in the folded, rolled form illustrated in FIG. 4(*c*).

Figure 5:
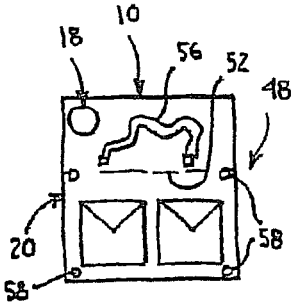
FIG. 5 is a plan view of a still further embodiment of a privacy blanket according to the principles of the present invention.

A further embodiment of a privacy blanket 10 according to the present invention is illustrated in FIG. 5. In this embodiment, a handle 56 is attached to or integral with the blanket body 12. While, in this embodiment, the handle 56 is attached to the first side surface 14 of the blanket body 12. However, it is envisioned that one or more handles 56 may be attached to the second side surface 16, an edge or any other position, such that the handle 56 allows the user to carry the privacy blanket 10 in the rolled or folded position.

Figure 6:
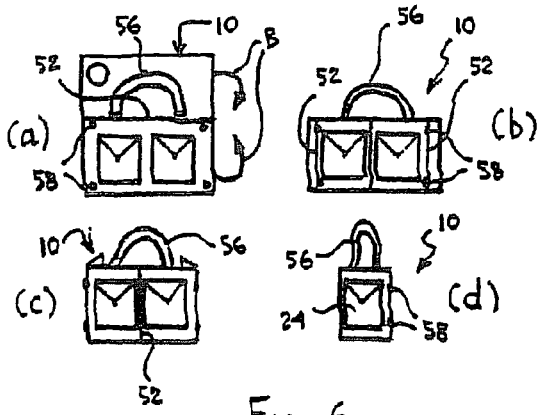
FIGS. 6(*a*)-(*d*) are plans of the privacy blanket of FIG. 5 during a preferred collapsing process.
Figure 7:
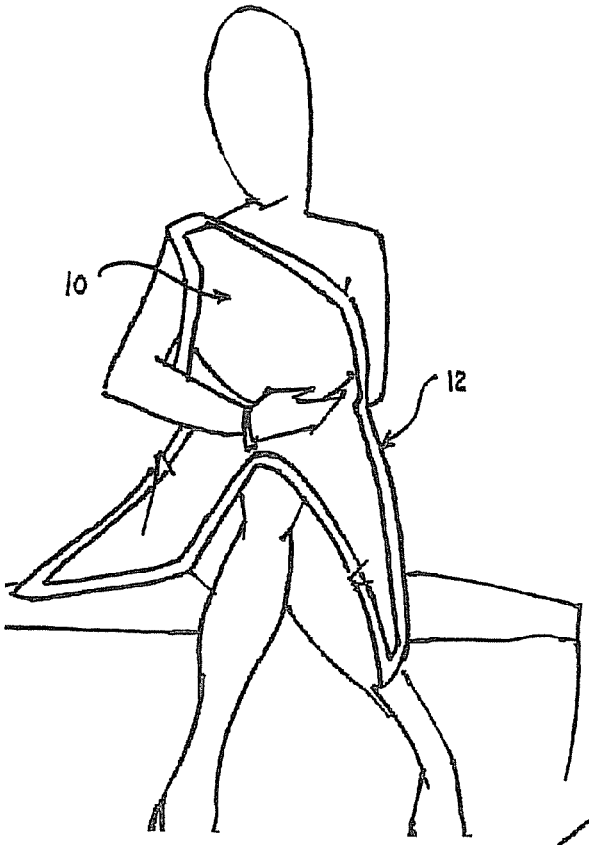
FIG. 7 is a schematic view of one embodiment of a privacy blanket according to the principles of the present invention while in use.
Figure 8:
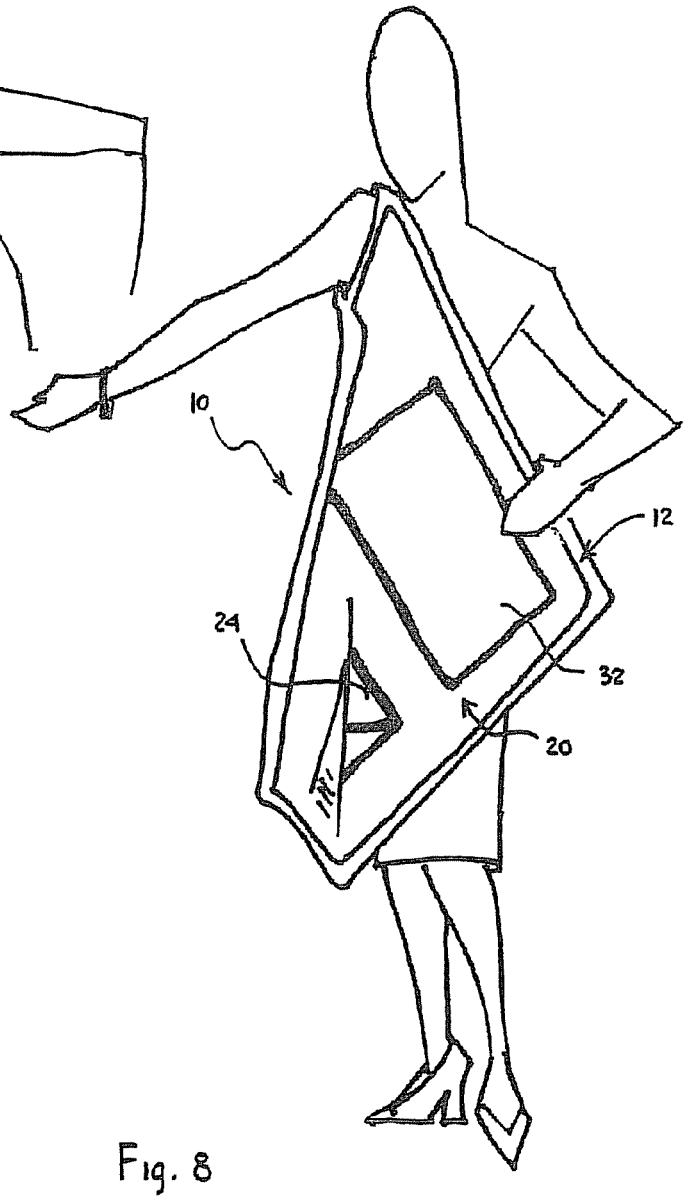
FIG. 8 is a schematic view of another embodiment of a privacy blanket according to the principles of the present invention while in use.

In order to collapse the privacy blanket 10 of FIG. 5, and with reference to FIG. 6(*a*), the blanket 12 is laid flat, and includes the above-referenced handle 56 and, as the attachment arrangement 48, two sets of snaps 58. In operation, the blanket body 12 is folded about fold line 52 in the direction of arrows B, resulting in the structure of FIG. 6(*b*). This allows for the handle 56 to be positioned at a top area of the folded blanket body 12. Next, the blanket is folded at fold lines 52 at or near the snaps 58. This step is illustrated in FIG. 6(*c*). Finally, the blanket body 12 is folded about fold line 52 in FIG. 6(*c*) and the snaps 58 attached together to create the folded privacy blanket 10 illustrated in FIG. 6(*d*).

As seen in FIG. 6, the flat blanket body 12 is transformed into a purse-like structure (see FIG. 6(*d*)), which includes a pocket 24 on either side of this folded structure with a handle 56 situated at the top area, such that the user can grasp and manipulate the folded privacy blanket 10. For example, the user may place the handle 56 over his or her shoulder, thereby using the folded privacy blanket 10 as a baby bag or the like. Accordingly, the user would not need to take a separate bag to store the various items and objects discussed above, instead using the privacy blanket 10 as both the structure for obtaining privacy in a public or semi-public place, as well as the structure for effectively storing and transporting the various items and objects that the user wishes to carry.

As discussed above, the blanket body 12 may range in size according to the size of the child or user. Further, the privacy blanket 10 may be manufactured according to the user's specification. Still further, the blanket body 12 or any of the portions thereof may be decorated with a specific type, color or pattern or material, and may include borders or other accents that lend to the aesthetic quality of the privacy blanket 10, whether in the form of a flat structure or a folded/rolled structure. In one preferred embodiment, the blanket body 12 is made from material that may be washed and dried. Other such features and functions are envisioned to be within the scope and context of the present disclosure.

In this manner, the privacy blanket 10 provides a unique and beneficial structure and arrangement for providing privacy and intimacy for any type of activities, where such privacy or intimacy is desired when in a public or semi-public place. Further, not only does the privacy blanket of the present invention provide privacy to the user, it also provides security and privacy to the infant or child during the nursing or feeding process. Still further, by including one or more functional portions 20, the folded and/or rolled privacy blanket 10 can be used to easily transport other objects and items associated with the user, and may be used as a replacement to existing baby bags or similar carriers. By using the built-in working area 32, the privacy blanket 10 permits the user to change the child in a clean area. Still further, and based upon the positioning of the engagement portions 18, the privacy blanket 10 will not fall away from or otherwise breach the privacy of the user. In summary, the privacy blanket 10 of the present invention provides a unique and innovative structure for maintaining privacy of the user, while including various additional and beneficial functions that overcome the drawbacks and deficiencies related with the prior art.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A privacy blanket comprising:

a blanket body having a first side surface, a second side surface, a top portion, and a bottom portion and comprising a first material;

at least one engagement portion configured to removably engage the privacy blanket with a user, the at least one engagement portion comprising an orifice defined at a top corner of the blanket body and configured for insertion of a body part of the user at least partially therethrough;

a working area adapted for changing a child positioned on at least a portion of the second side surface of the blanket body, the working area comprising a second material;

at least one attachment arrangement; and a handle positioned on the first side surface of the blanket body, wherein the blanket body is foldable between a closed baby bag position defining a baby bag and an open use position, wherein, when the blanket body is folded in half, the handle is positioned at a top portion of the baby bag to allow a user to carry the baby bag, and wherein, in the baby bag position, the blanket body is folded such that the first side surface defines an outer surface of a baby bag, and the second side surface and the working area are folded into an interior of the baby bag, the at least one attachment arrangement releasably maintaining the blanket body in the baby bag position, wherein, upon release of the attachment arrangement the baby bag is adapted to be unfolded into the open use position.

2. The privacy blanket of claim 1, further comprising at least one elongate structure having a first end and a second end, the first and second ends being attached to the top portion of the blanket body, the at least one elongate structure configured for insertion of a body part of the user at least partially therethrough.

3. The privacy blanket of claim 1, further comprising a pocket having an inner area and comprising a closure portion positioned at a top of the pocket, wherein the closure portion is moveable between an open position and a closed position.

4. The privacy blanket of claim 3, wherein the pocket is positioned on the first side surface of the blanket body, such that, when the blanket body is folded in the baby bag position, the pocket is positioned on the outer surface of the baby bag.

5. The privacy blanket of claim 3, wherein the closure portion includes an attachment arrangement for removably securing the closure portion in the closed position.

6. The privacy blanket of claim 5, wherein the pocket attachment arrangement is in the form of at least one of the following: at least one clasp, at least one button, at least one zipper, a hook-and-loop arrangement, an adhesive arrangement, a tie arrangement, at least one string, at least one ribbon, at least one elongate structure, or any combination thereof.

7. The privacy blanket of claim 1, further comprising a second pocket having an inner area and comprising a closure portion positioned at a top of the pocket wherein the closure portion is moveable between an open position and a closed position, wherein the closure portion of the second pocket defines a slit-shaped access slot configured to provide access to the inner area of the pocket therethrough and configured to provide successive removal of at least one of the following: a tissue, a wipe, a cloth material, a paper material, or any combination thereof.

8. The privacy blanket of claim 3, wherein at least a portion of the inner area is lined with at least one of the following: an absorbent material, a liquid-proof material, a liquid-resistant material, an insulator material, a non-abrasive material, a non-allergenic material, or any combination thereof.

9. The privacy blanket of claim 1, further comprising a pocket positioned on at least a portion of the second side surface of the blanket body, wherein the pocket includes at least one elastic portion configured to tighten around at least one item positioned at least partially within the inner area of the pocket.

10. The privacy blanket of claim 1, wherein the attachment arrangement comprises at least one of the following: at least one clasp, at least one button, at least one zipper, a hook-and-loop arrangement, an adhesive arrangement, a tie arrangement, at least one string, at least one ribbon, at least one elongate structure, or any combination thereof.

11. The privacy blanket of claim 1, wherein the orifice is adjustable.

12. The privacy blanket of claim 11, wherein the orifice comprises at least one of a strap/clip structure or a pull tie structure integral with the periphery of the orifice.

13. The privacy blanket of claim 1, wherein the working area adapted for changing a child comprises an absorbent material, a liquid-proof material, a liquid-resistant material, an insulator material, a non-abrasive material, a non-allergenic material, or any combination thereof.

14. The privacy blanket of claim 1, further comprising an attachment mechanism positioned on the center portion of the second side surface of the blanket body for attaching a toy to the blanket body.

15. The privacy blanket of claim 1, wherein the orifice comprises a circular aperture defined at the top corner of the top portion of the blanket body.

16. The privacy blanket of claim 15, further comprising an elastic member positioned around the periphery of the circular aperture.

* * * * *